US005237798A

United States Patent [19]

Fukuda

[11] Patent Number: 5,237,798

[45] Date of Patent: Aug. 24, 1993

[54] PACKAGING MACHINE WITH IMPROVED FILM-TRANSPORTING DEVICE

[75] Inventor: Masao Fukuda, Shiga, Japan

[73] Assignee: Ishida Scales Mfg. Co., Ltd., Kyoto, Japan

[21] Appl. No.: 909,952

[22] Filed: Jul. 7, 1992

[30] Foreign Application Priority Data

Jul. 12, 1991 [JP] Japan ..... 3-198864

[51] Int. Cl.[5] ..... B65B 9/20; B65B 41/16

[52] U.S. Cl. ..... 53/551; 53/389.4

[58] Field of Search ..... 53/551, 552, 554, 389.4

[56] References Cited

U.S. PATENT DOCUMENTS

| | | | |
|---|---|---|---|
| 3,432,980 | 3/1969 | Seiferth et al. | 53/551 X |
| 3,557,525 | 1/1968 | Bauder | 53/551 |
| 4,744,202 | 5/1988 | Wylie | 53/551 X |
| 4,800,707 | 1/1989 | Rabus | 53/552 |
| 4,989,376 | 2/1991 | Backman | 53/389.4 X |
| 5,014,498 | 5/1991 | McMahon | 53/551 X |

*Primary Examiner*—Horace M. Culver
*Attorney, Agent, or Firm*—Heller, Ehrman, White & McAuliffe

[57] ABSTRACT

A form-fill-seal type packaging machine pulls an elongated film out of a film roll, directs it to a former to roll the film into a cylindrical form and produces bags by longitudinally sealing the overlapping side edges of the film and transversely sealing the tubular film at top and bottom positions. A roller-like film-guiding piece normally disposed adjacent to the former is on a slidable base plate so as to be retractable away from the former for the convenience of the operator when the film is initially set or when the former is replaced by another one. The slidable plate can be automatically stopped at its normal position adjacent to the former by detecting the extension of the former by a sensor. A device for straightening the film undergoing a zigzag motion is also supported by this slidable plate and hence can be retracted away from the former.

8 Claims, 3 Drawing Sheets

PACKAGING MACHINE WITH IMPROVED FILM-TRANSPORTING DEVICE

BACKGROUND OF THE INVENTION

This invention relates to a so-called form-fill-seal type packaging machine having an improved device for transporting an elongated flexible film material from which bags are to be made by means of a former. More particularly, this invention relates to such a packaging machine capable of effectively straightening the film undergoing a zigzag motion and also of easily retracting a guide roller for the film and the film-straightening device away from the former as well as automatically positioning them near the former.

As shown in FIG. 3, a prior art packaging machine of the form-fill-seal type may be characterized as having a frame 2 which is vertically slidable with respect to a base 7 and a film roll 1 supported by a cantilevered shaft 3 which extends perpendicularly to the front-back direction of the machine. An elongated flexible bag-forming material (hereinafter referred to as a film 4) is pulled out of the film roll 1 and is directed in the forward direction to a former 6 through guide rollers 8, 9 and 32 as well as a dancer roller 10. The former 6 is of a conventional kind, having a skirt-like structure 12 (hereinafter simply referred to as "the skirt") and serving to transform the film 4 into a cylindrical shape. The overlapping side edges of the film are sealed together by means of a vertical sealer 61 to form a tube, and an end sealer 62 is operated to seal the tube at top and bottom positions to form a bag.

Prior art packaging machines thus structured encounter several problems. Firstly, although one of the guide rollers (32) at the downstream end (along the path of travel by the film 4 from the film roll 1 to the former 6) is normally placed adjacent to the skirt 12 so as to be able to guide the film 4 smoothly over to the former 6, it must be removed away from its normal position when the film 4 is initially set or when the former 6 is to be replaced by another of a different kind. Since such removal operations are usually carried out manually, workability of the machine is adversely affected. Secondly, the film 4 must be prevented from moving in a zigzag because its side edge portions should desirably always overlap by the same amount. Although a means is generally provided for straightening the film 4 as it begins to slide transversely to its direction of intended motion, such film-straightening means should be placed as close to the former 6 as possible in order to be effective. If it is too close to the former 6, however, it will stand in the way of the operator when the film 4 is set or the former 6 is exchanged, as mentioned above. Moreover, the film-straightening means will include means for detecting the deviation of the film 4 from its normal course, and this will have the undesirable effect of increasing the number of components of the machine and complicating its structure.

It is therefore a general object of the present invention to eliminate the disadvantages of prior art packaging machines described above by providing a packaging machine with an improved film-transporting device such that its guide roller and film-straightening means can be retracted automatically without requiring the operator's manual operations when the film is initially set or the former is exchanged such that the workability of the machine can be improved. It is a further object of the present invention to accomplish the above without unduly increasing the number of components or the overall size of the machine.

SUMMARY OF THE INVENTION

This invention relates to a form-fill-seal type packaging machine with a former having a skirt-like structure. An elongated film pulled out of a film roll is made into a cylindrical shape by leading it to the skirt of the former with the help of a roll-like elongated guiding member, a longitudinal sealer seals its side edges together to form a tube, and an end sealer seals it transversely at top and bottom ends to thereby form a bag. In order to satisfy the above and other objects, a sliding member is provided according to the present invention such that the guiding member for leading the film to the skirt of the former can be retracted from its normal position adjacent to the skirt. This sliding member is provided with a positioning mechanism for stopping the guiding member adjacent to the skirt when it is brought closer to the former from its retracted position by the sliding member. The sliding member is further provided with a mechanism for correcting the effects of transverse deviations of the film from its intended travel path. This mechanism is comprised of a pair of elongated members which are maintained parallel to each other and a means for rotating them within the plane of the motion of the film. One of these elongated members is provided with a load cell and is adapted to detect the tension within the film. The output from this load cell is inputted as a feedback to the control device for controlling the pulling of the film from the film roll, thereby adjusting the film tension to a preset level.

With a packaging machine thus structured, both the guiding member and the mechanism for correcting the transverse deviations of the film path can be retracted away from the former so as not to be in the way of the operator when, for example, a new film is set in the path or the former is removed to be replaced by a new one. After the operator's job is done, the sliding member is automatically stopped such that the guiding member is positioned adjacent to the skirt of the former.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

A packaging machine embodying the present invention will be described with reference to FIGS. 1 and 2. In these figures, components and parts which are identical or substantially similar to those described above with reference to the prior art machine of FIG. 3 will be indicated by the same numerals and will not be explained separately.

Figure 1:
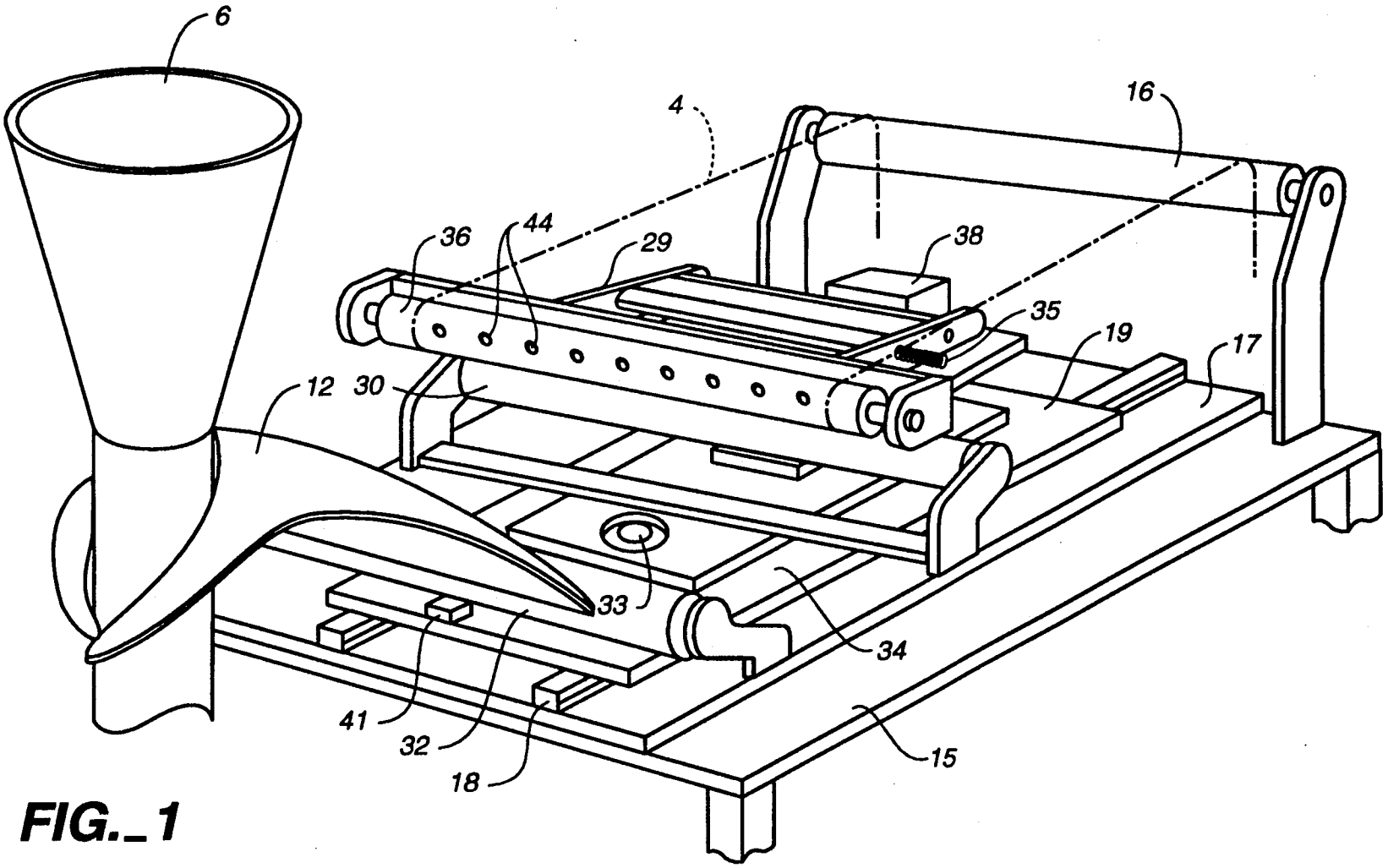
FIG. 1 is a perspective view of some of essential parts of a film-transporting device for a packaging machine embodying the present invention.

In FIG. 1, numeral 15 indicates the ceiling of the housing for the packaging machine. A guide roller (referred to as the upstream guide roller 16) is axially supported on the ceiling 15 away from the former 6 and extending perpendicularly to the direction of the path of the film 4 such that the film 4, which is pulled upwards from the film roll (not shown in FIG. 1), is directed forward towards the former 6. A supporting plate 17 with a parallel pair of guide rails 18 directed towards the former 6 is provided on top of the ceiling 15, and a base plate 19 is placed parallel to and above the supporting plate 17. Sliders 21, which engage and slide along the guide rails 18, are attached to the bottom surface of the base plate 19 such that the base plate 19 itself can slidably move towards or away from the former 6. On the top surface of the base plate 19 proximally to the former 6, another guide roller (referred to as the downstream guide roller 32) is axially supported parallel to the upstream guide roller 16. As shown in FIG. 2, a pair of legs 22 is also attached to the bottom surface of the base plate 19, extending downward through an opening (not shown) in the ceiling 15 of the machine housing and the supporting plate 17. A connector shaft 23 between these legs 22 is provided with a nut 24 engaging a screw shaft 27 which extends parallel to the guide rails 18 and is adapted to be rotated by a motor 26 contained inside the housing for the packaging machine.

Figure 2:
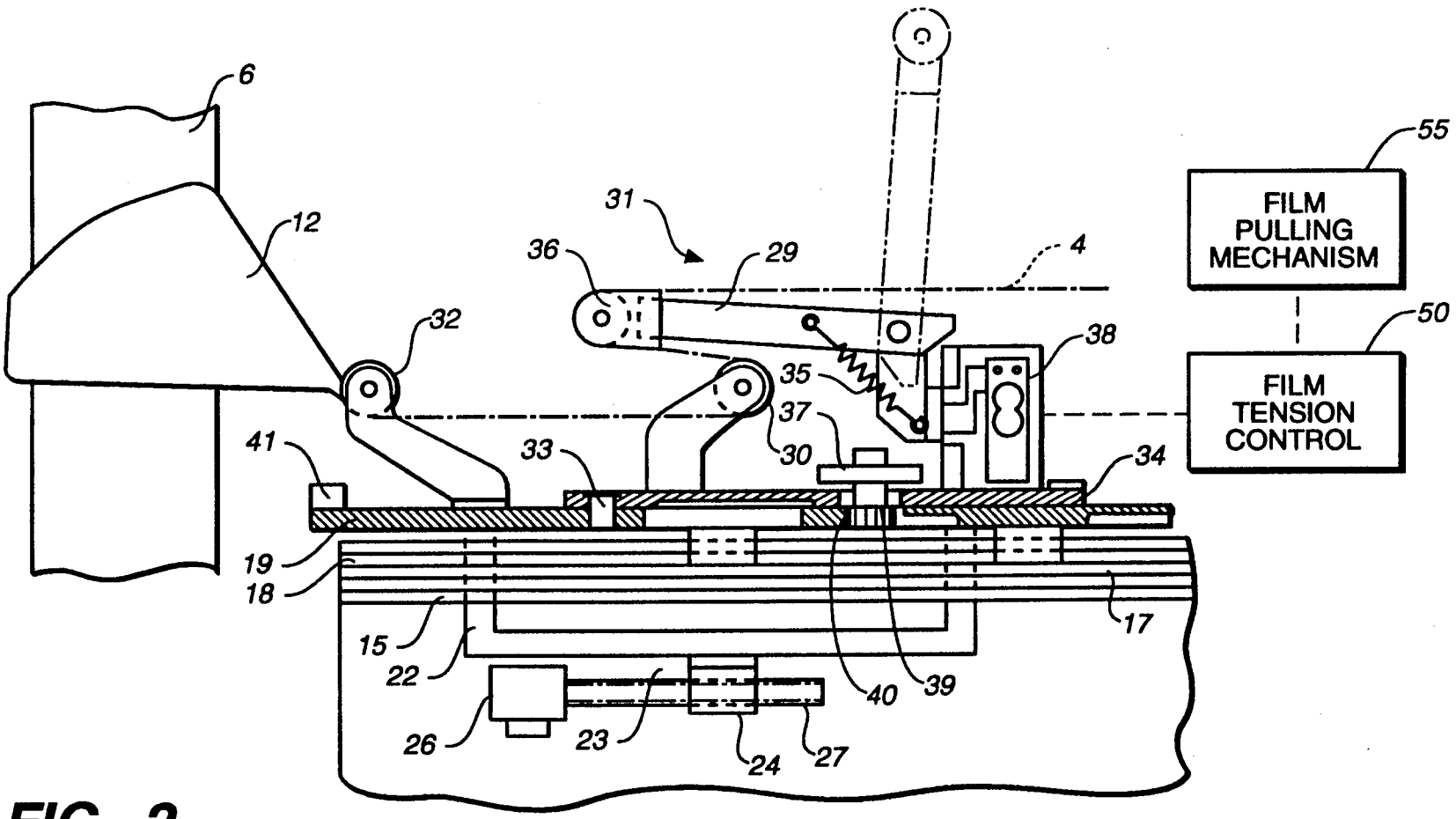
FIG. 2 is a partially sectional side view of the film-transporting device of FIG. 1.

In FIG. 2, numeral 31 generally indicates a film-straightening device according to the present invention, provided near the former 6 on its upstream side (with reference to the direction of motion of the film 4) for preventing the film 4 from undergoing a zigzag motion. This film-straightening device 31 includes a rotatable plate 34 axially supported by a pin 33 on the top surface of the base plate 19, a downstream guide pipe 30 supported normally parallel to the guide rollers 16 and 32 on the rotatable plate 34 between the pin 33 and the upstream guide roller 16, a film-straightening motor 37, a load cell 38, a swing lever 29 and an upstream (tension-detecting) guide pipe 36 maintained parallel to the downstream guide pipe 30. The motor 37 and the load cell 38 are disposed on the surface of the rotatable plate 34 between the downstream guide pipe 30 and the upstream guide roller 16, the motor 37 being disposed closer to the guide pipe 30 and the load cell 38 closer to the upstream guide roller 16. The swing lever 29 is axially supported by the load cell 38 near one of its ends and supports at the other of its ends the tension-detecting guide pipe 36. A spring 35 is provided between the load cell 38 and the swing lever 29 such that its biasing force tends to keep the swing lever 29 normally in the nearly horizontal position shown by solid lines in FIG. 2. When the swing lever 29 is in this normal position, the tension-detecting guide pipe 36 assumes a position slightly above the downstream guide pipe 30 so as to define an S-shaped portion in the travel path of the film 4 between the guide rollers 16 and 32. The two guide pipes 30 and 36 are each provided with small air holes 44, as shown in FIG. 1, on the portions of their surfaces which contact the film 4 as the direction of motion of the film 4 is reversed thereby. Outward air flows through these holes 44 serve to reduce the friction between the film 4 and these pipes 30 and 36 during the operation of the machine. The drive shaft of the motor 37 penetrates through an opening provided in the rotatable plate 34. A pinion 39, attached to this drive shaft, engages a fan-shaped rack 40 fastened to the base plate 19. Affixed onto the base plate 19 near its front edge (near the former 6) is a sensor 41 for detecting the skirt 12 of the former 6.

Figure 3:
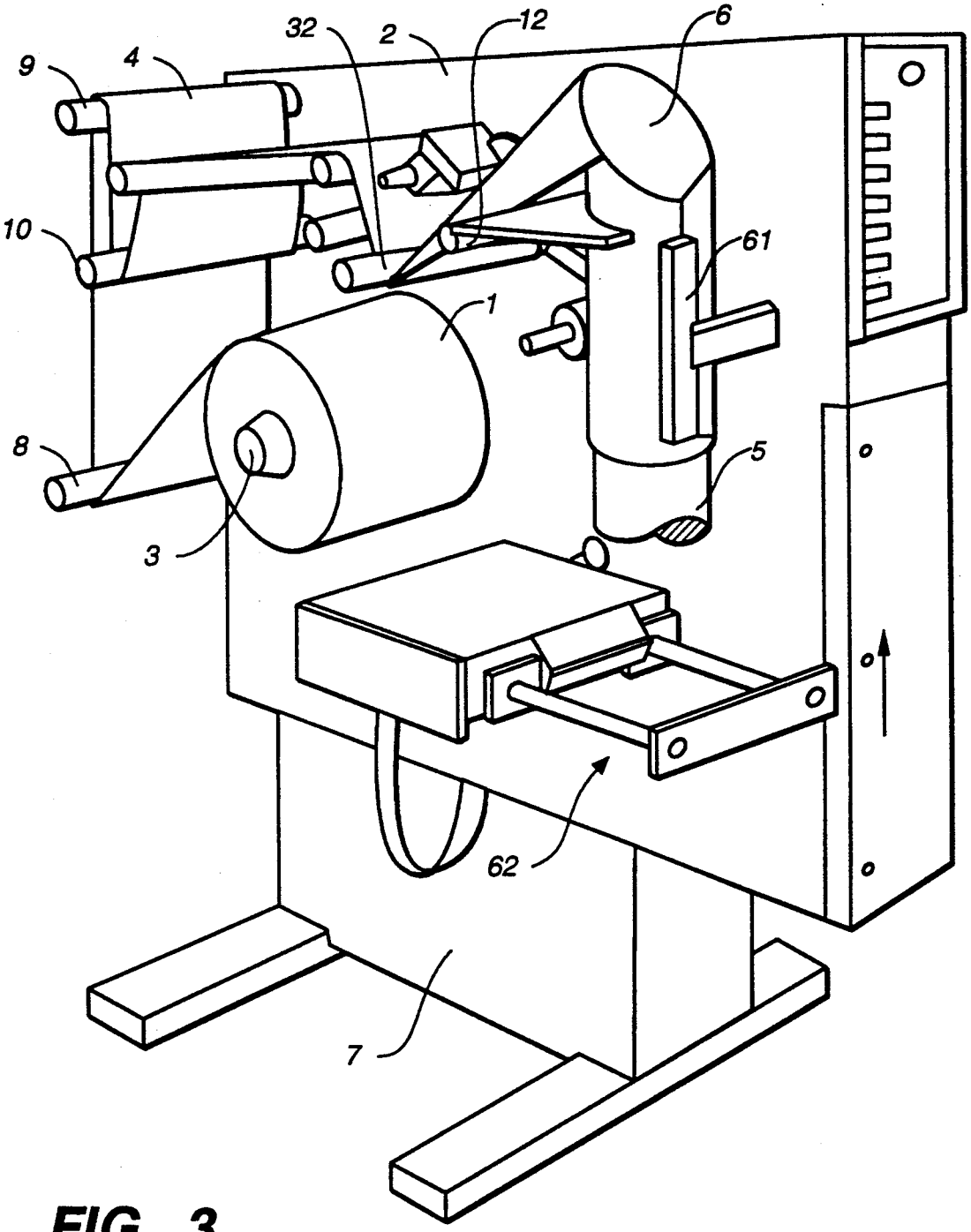
FIG. 3 (PRIOR ART)
FIG. 3 is a diagonal view of an example of prior art packaging machine of the form-fill-seal type.

To operate a packaging machine as described above, the film 4 is pulled out of a film roll supported by a shaft (not shown in FIGS. 1 and 2), directed from the upstream guide roller 16 to the downstream guide roller 32 by passing half-way around each of the guide pipes 36 and 30, formed into a tubular shape by the former 6 as its overlapped side edges are sealed together and eventually made into bags by having upper and lower ends transversely sealed as in part described with reference to FIG. 3.

In order to improve the efficiency of such a bag-making operation, it has been known to place the downstream guide roller 32 as close as practicable to the skirt 12 of the former 6 such that the downstream guide roller 32 will be able to cause the incoming film 4 to smoothly start moving along the skirt. 12 If this guide roller 32 is placed too close to the skirt 12, however, it tends to get in the way of the operator when the film 4 is initially set from the film roll to the former 6 or when the former 6 is removed and another former is installed. For this reason, the downstream guide roller 32 according to the present invention is made retractable by a safe distance from the position shown in FIGS. 1 and 2 by activating the base plate advancing motor 26 to rotate the screw shaft 27 such that the motive force of the motor 26 is communicated through the nut 24, the connector shaft 23 and the legs 22 to the base plate 19, causing the base plate 19 to slide along the guide rails 18. The downstream guide roller 32, being affixed to the base plate 19, thereby also moves away from the skirt 12, giving the operator enough space to maneuver for setting the film 4 or for exchanging formers.

After the new film 4 has been set or a new former 6 has been attached, the motor 26 is activated again in the reverse direction to cause the base plate 19 to advance towards the former 6. As soon as the distal edge of the skirt 12 away from the former 6 is detected by the sensor 41 near the front edge of the base plate 19 where the downstream guide roller 32 is located, a detection signal is outputted from the sensor 41, automatically causing the motor 26 to stop its movement. When the forward motion of the base plate 19 is thus stopped, the downstream guide roller 32 is adjacent to the skirt 12.

Although not shown in FIG. 1 or 2, there is also provided an edge sensor, for example, of a conventional type disposed both above and below the film 4 for detecting the position of one of its side edges to thereby detect its zigzag motion. When this edge sensor detects such a zigzag motion of the film 4 during the operation of the machine, a signal to this effect is outputted therefrom to cause the film-straightening motor 37 to rotate the pinion 39 engaging the fan-shaped rack 40 attached to the base plate 19. The rotatable table 34 is thereby caused to rotate around the pin 33, changing the direction of extension of the mutually parallel guide pipes 36 and 30 with respect to the direction of motion of the film 4. The zigzag motion of the film 4, or its lateral motion with respect to its direction of motion, is thus corrected as the film 4 moves along the S-shaped portion of its travel path around these guide pipes 36 and 30. It now goes without saying that the closer such a film-straightening device 31 is placed to the former 6, the better it can function with improved response characteristics. According to the present invention, the entire film-straightening device 31 including the parallel pipes 36 and 30, the motor 37, the pinion 39 and the rack 40 is retracted, as explained above. At the same time, upstream guide pipe 36 is additionally moved away from the former 6 by rotating the swing lever 29 upward against the biasing force of the spring 35 to a nearly vertical retracted position shown by broken lines in FIG. 2.

During a normal operation of the packaging machine, the tension in the film 4 is communicated through the upstream tension-detecting guide pipe 36 to the load cell 38. If the tension, as measured by the load cell 38, exceeds a specified preset level, a control signal indicative of the excess is communicated from the load cell 38 to a tension controlling device (shown schematically in FIG. 2 at 50) for controlling a mechanism (shown schematically in FIG. 2 at 55) for pulling the film 4 from the film roll 1, thereby adjusting the film tension to the preset level.

The present invention has been described above by way of only one example, but this example is not intended to limit the scope of the invention. Many modifications and variations can be made within the scope of this invention. For example, the base plate 19 may be caused to slide on an endless belt or the like when it is moved away from the former 6. As another example, the mutually parallel guide pipes 36 and 30 with air holes 44 may be replaced by axially supported rollers although such use has the disadvantage of increased friction with the film 4. Furthermore, these guide pipes 36 and 30 need not be tubular. In situations where the friction with the film 4 is not a serious trouble, these guide pipes 36 and 30 may be replaced by elongated rod-like members with a surface area with a semicircular sectional shape.

What is claimed is:

1. A form-fill-seal type packaging machine comprising:

a former having a skirt-like structure for forming an elongated film pulled out of a film roll into a tubular shape;

a longitudinal sealer for longitudinally sealing side edges of said pulled out film;

an end sealer for transversely sealing said tubularly formed film at top and bottom ends to thereby form a bag;

an elongated guiding member for guiding said film directly to said skirt-like structure;

a slidable member supporting said guiding member and adapted to move selectively towards or away from said skit-like structure; and a positioning mechanism for automatically stopping said slidable member so as to position said guiding member adjacent to said skirt-like structure.

2. The packaging machine of claim 1 wherein said slidable member is adapted to slide on guiding rails between a normal position where said guiding member is adjacent to said skirt-like structure and a retracted position which is further removed away from said former than said normal position is.

3. A form-fill-seal type packaging machine comprising:

former having a skirt-like structure for forming an elongated film pulled out of a film roll into a tubular shape;

a longitudinal sealer for longitudinally sealing side edges of said pulled out film;

an end sealer for transversely sealing said tubularly formed film at top and bottom ends to thereby form a bag;

an elongated guiding member for guiding said film to said skirt-like structure;

a slidable member supporting said guiding member and adapted to move selectively towards or away from said skit-like structure; and a positioning mechanism for automatically stopping said slidable member so as to position said guiding member adjacent to said skirt-like structure;

said packaging machine having a defined film path along which said film is transported from said film roll to said former, said slidable member also supporting film-straightening means for correcting transverse deviations of said film from said film path.

4. The packaging machine of claim 3 wherein said film-straightening means includes a pair of mutually parallel elongated direction-adjusting members disposed within said film path, said film path having an S-shaped portion around said direction-adjusting members, and a direction-adjusting motor for changing the orientation of said pair of direction-adjusting members with respect to said film path.

5. The packaging machine of claim 4 further comprising:

a load cell for measuring the tension in said film, one of said direction-adjusting members being supported by said load cell;

film-driving means for causing said film to be pulled out of said film roll; and tension control means for receiving outputs from said load cell as feedback signal and controlling said film-driving means according to said feedback signal.

6. The packaging machine of claim 4 wherein said direction-adjusting members are tubular and have air holes on portions of their surfaces which contact said film.

7. The packaging machine of claim 4 wherein said pair of direction-adjusting members is supported on a movable plate adapted to rotate with respect to said film path, said movable plate being in motion-communicating relationship with said direction-adjusting motor.

8. The packaging machine of claim 3 wherein said elongated guiding member substantially consists of a roller which is axially supported so as to extend perpendicularly to said film path and to be rotatable axially, said film from said film roll being caused to pass partially around said roller.

* * * * *